US009446595B2

(12) United States Patent
Takarabe et al.

(10) Patent No.: US 9,446,595 B2
(45) Date of Patent: Sep. 20, 2016

(54) INK JET PRINTING APPARATUS AND METHOD FOR CONTROLLING THE SAME

(71) Applicant: CANON KABUSHIKI KAISHA, Tokyo (JP)

(72) Inventors: Kei Takarabe, Kawasaki (JP); Akiyoshi Sahara, Funabashi (JP); Toshiyuki Kuroda, Yokohama (JP); Atsushi Takahashi, Tama (JP); Kei Kosaka, Tokyo (JP); Tomoyuki Tenkawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/829,000

(22) Filed: Aug. 18, 2015

(65) Prior Publication Data

US 2016/0052266 A1 Feb. 25, 2016

(30) Foreign Application Priority Data

Aug. 25, 2014 (JP) ..... 2014-170344

(51) Int. Cl.
*B41J 2/165* (2006.01)
*B41J 2/19* (2006.01)

(52) U.S. Cl.
CPC ..... *B41J 2/1652* (2013.01); *B41J 2/16508* (2013.01); *B41J 2/19* (2013.01); *B41J 2002/16573* (2013.01)

(58) Field of Classification Search
None
See application file for complete search history.

(56) References Cited

U.S. PATENT DOCUMENTS 6,174,042 B1 * 1/2001 Kobayashi ..... B41J 2/1652 347/23
6,672,703 B2 1/2004 Kohno
2015/0049138 A1 2/2015 Aoyama et al.

FOREIGN PATENT DOCUMENTS

JP 2001-232815 A 8/2001

* cited by examiner

*Primary Examiner* — Lisa M Solomon
(74) *Attorney, Agent, or Firm* — Fitzpatrick, Cella, Harper & Scinto

(57) ABSTRACT

There is provided an ink jet printing apparatus that does not give poor usability to users and a method for controlling the same. To achieve this, in recovery processing performed multiple times to recover an ejection state, in a case where a printing instruction is inputted, the recovery processing is suspended in an amount smaller than an amount required for recovery, depending on an amount of ink in an ink tank.

6 Claims, 14 Drawing Sheets

INK JET PRINTING APPARATUS AND METHOD FOR CONTROLLING THE SAME

BACKGROUND OF THE INVENTION

1. Field of the Invention

The present invention relates to an ink jet printing apparatus for performing printing by ejecting ink supplied from an ink tank and a method for controlling the same.

2. Description of the Related Art

In general, an ink jet printing apparatus forms an image by ejecting ink supplied from an ink tank onto a print medium from a plurality of ejection ports provided in a print head. If the ink tank becomes empty after ink is used up, the ink tank is replaced with a new one. In replacement, bubbles may enter an ink flow path that leads to the print head. The entry of the bubbles in the ink flow path may not allow the ink to be properly supplied to the print head, causing a malfunction in printing, such as non-ejection.

To avoid such a malfunction in printing, recovery processing is performed in which bubbles are sucked with ink in the ejection ports and removed for recovery of an ejection state. However, the recovery processing involves consumption of ink that does not contribute to printing, and therefore, ink may be wasted if the recovery processing is performed more than necessary.

Japanese Patent Laid-Open No. 2001-232815 discloses determining whether recovery processing is needed to perform recovery processing at an appropriate timing.

In the recovery processing, a sufficient number of times of suction is performed to totally discharge bubbles. If recovery processing is needed, however, performing printing processing after performing a sufficient number of times of the recovery processing requires a long time before the printing processing is started, whereby a user is forced to wait until printing is started. This gives poor usability to the user.

SUMMARY OF THE INVENTION

The present invention provides an ink jet printing apparatus that does not give poor usability to users and a method for controlling the same.

Accordingly, an ink jet printing apparatus comprises a print head that ejects ink to perform printing; a recovery unit configured to be able to perform recovery processing of a predetermined amount to recover a printing performance of the print head; a determination unit configured to, in a case where a printing instruction is inputted while the recovery processing is performed by the recovery unit, determine whether the recovery processing of the predetermined amount can be suspended, depending on a state of a factor affecting the printing performance of the print head; and a print control unit configured to, in a case where the determination unit determines that suspension is possible, perform printing based on a printing instruction after suspension of the recovery processing of the predetermined amount.

According to the present invention, it is possible to achieve an ink jet printing apparatus that does not give poor usability to users and a method for controlling the same.

Further features of the present invention will become apparent from the following description of exemplary embodiments (with reference to the attached drawings).

DESCRIPTION OF THE EMBODIMENTS

First Embodiment

A first embodiment of the present invention will now be described with reference to the attached drawings.

(System Configuration)

Figure 1:
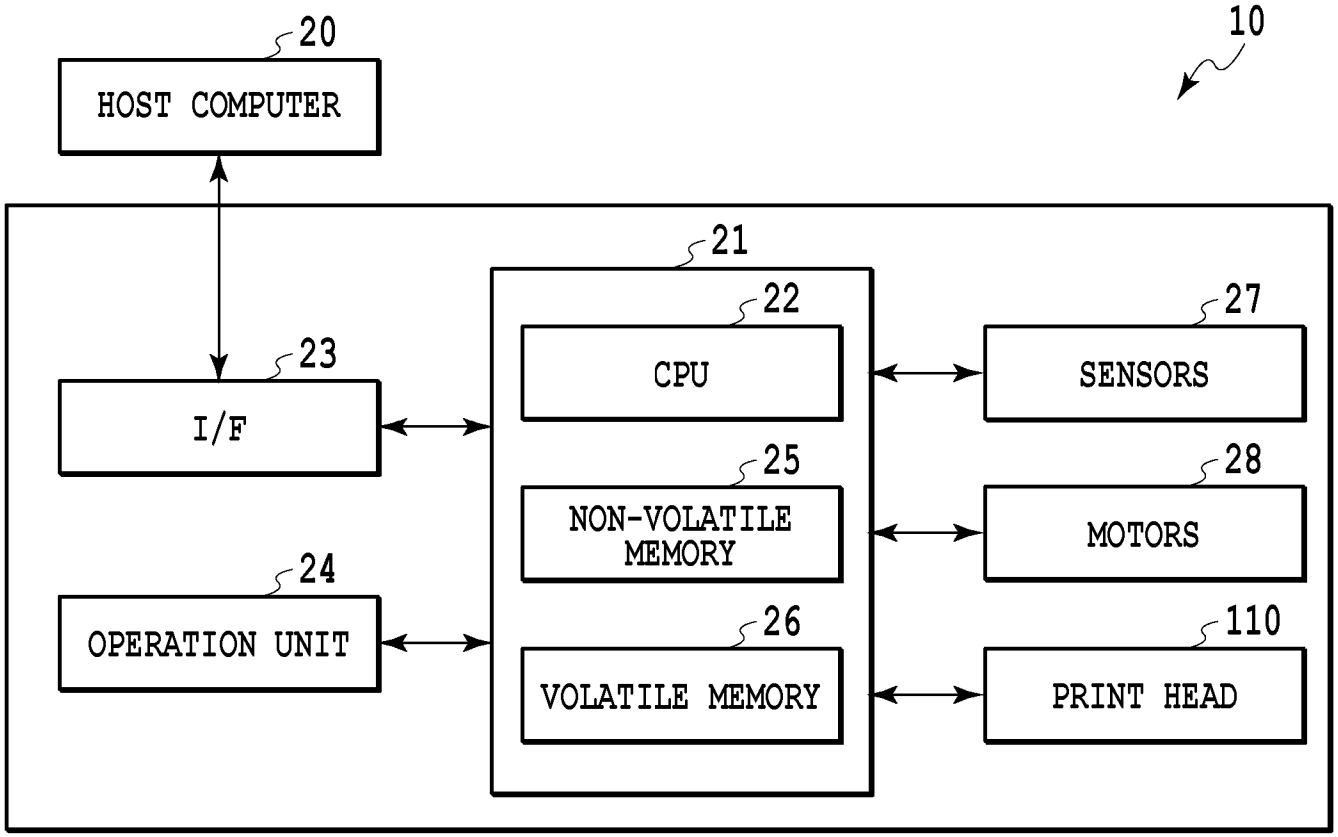
FIG. 1 is a block diagram showing a system configuration of an ink jet printing apparatus.

FIG. 1 is a block diagram showing a system configuration of an ink jet printing apparatus, focusing on a control unit. With reference to FIG. 1, a system configuration of an ink jet printing apparatus 10 will be described.

The ink jet printing apparatus 10 has an I/F 23, an operation unit 24, a control unit 21, sensors 27, motors 28, and a print head 110. The control unit 21 has a non-volatile memory 25, a volatile memory 26, and a CPU 22. The non-volatile memory 25 stores therein control information that is permanently recorded even if a control program or power is OFF. The volatile memory 26 stores therein control information that is deleted if power is OFF. The CPU 22 is a processor for executing a control program stored in the non-volatile memory 25.

In the present embodiment, the non-volatile memory 25 uses a flash memory, and part of the flash memory is used as a non-volatile information storage area. The non-volatile information storage may also be a separate non-volatile memory such as an EEP memory. The control unit is connected to a host computer 20 via the I/F 23 to receive print image data or attribute information on the print image from the host computer 20. The control unit 21 is also connected to the operation unit 24 for a user to perform settings or status confirmation in the ink jet printing apparatus.

The control unit 21 is connected to the sensors 27 and can acquire sensor signals from the sensors 27. The control unit 21 is also connected to the motors 28 and the print head 110 to drive the motors 28 and control the print head 110, whereby a printing operation is performed.

(Schematic Configuration of the Apparatus Body)

Figure 2:
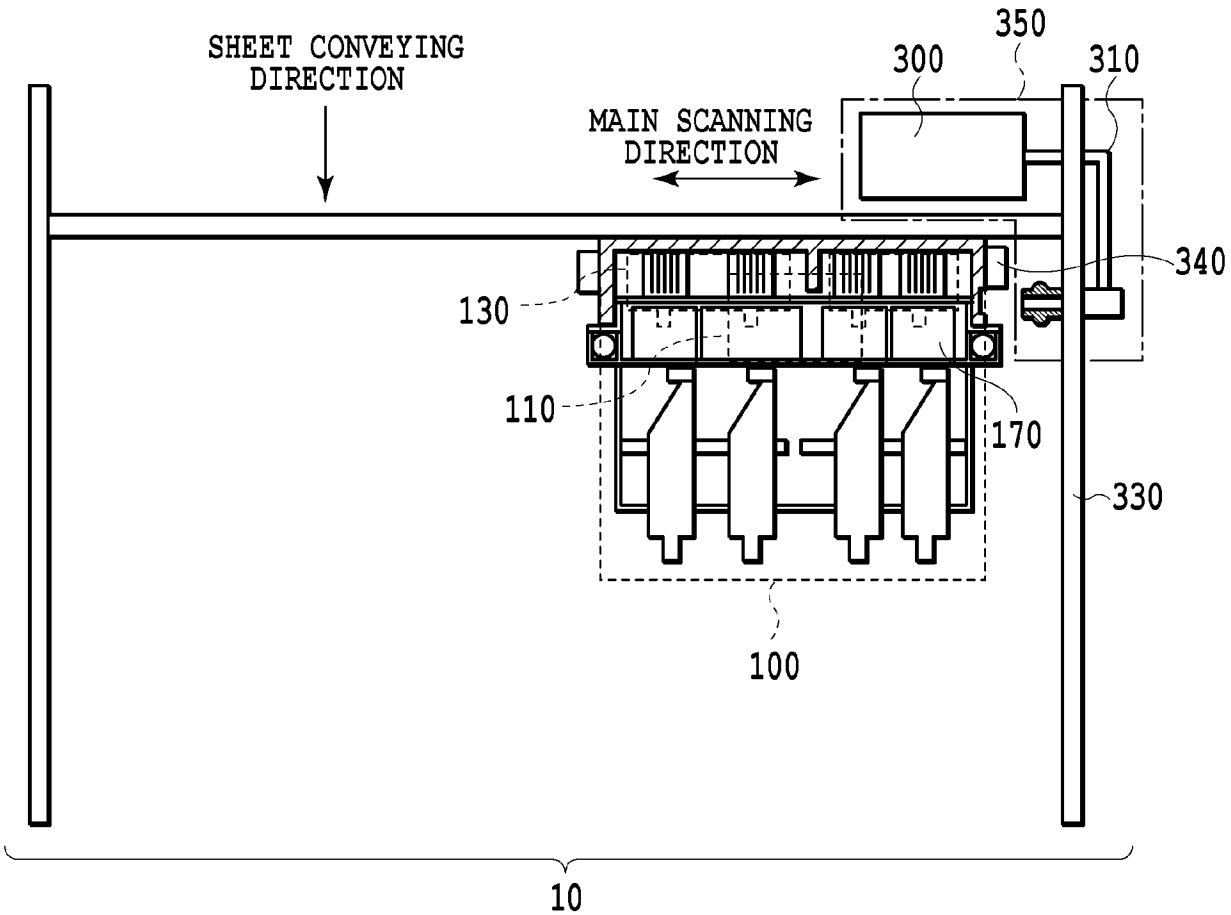
FIG. 2 is a schematic top view showing an internal configuration of the ink jet printing apparatus.
Figure 3:
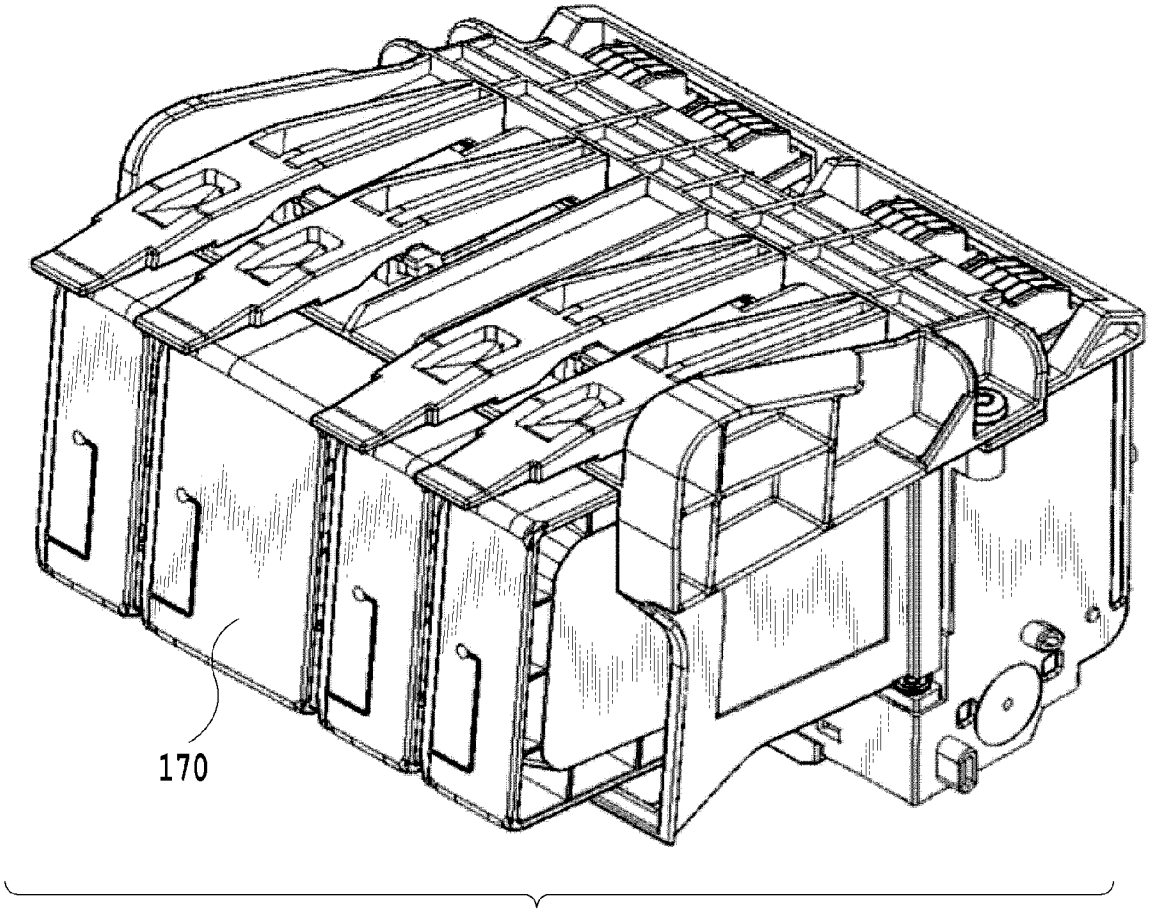
FIG. 3 is an enlarged view showing details of a print head unit.

FIG. 2 is a schematic top view showing an internal configuration of the ink jet printing apparatus. FIG. 3 is an enlarged view showing details of a print head unit 100 of FIG. 2. With reference to FIGS. 2 and 3, the configuration of the ink jet printing apparatus 10 according to the embodiment of the present invention will be described. The ink jet printing apparatus 10 prints an image on a print medium by using inks of four colors; yellow (Y), magenta (M), cyan (C), and black (Bk). The ink jet printing apparatus 10 has a feeding device, the print head unit 100, a carriage unit 340, and a purge unit 350 provided with a pump unit 300. Furthermore, the ink jet printing apparatus 10 is provided with a feeding tray on its bottom.

A print medium loaded onto the feeding tray is picked up by the feeding device. The pump unit 300 has a tube 310, a motor, and a tube pump having a roller member for retaining a tube. Further, the print head unit 100 is mounted on the carriage unit 340. The print head unit 100 has the print head 110 for injecting ink droplets into a print medium, a sub tank 130 for supplying ink to the print head 110, and a main tank 170 for supplying ink to the sub tank 130. The sub tank 130 is provided corresponding to a color of ink used in the ink jet printing apparatus 10.

(Regarding the Structure of the Sub Tank)

Figure 4:
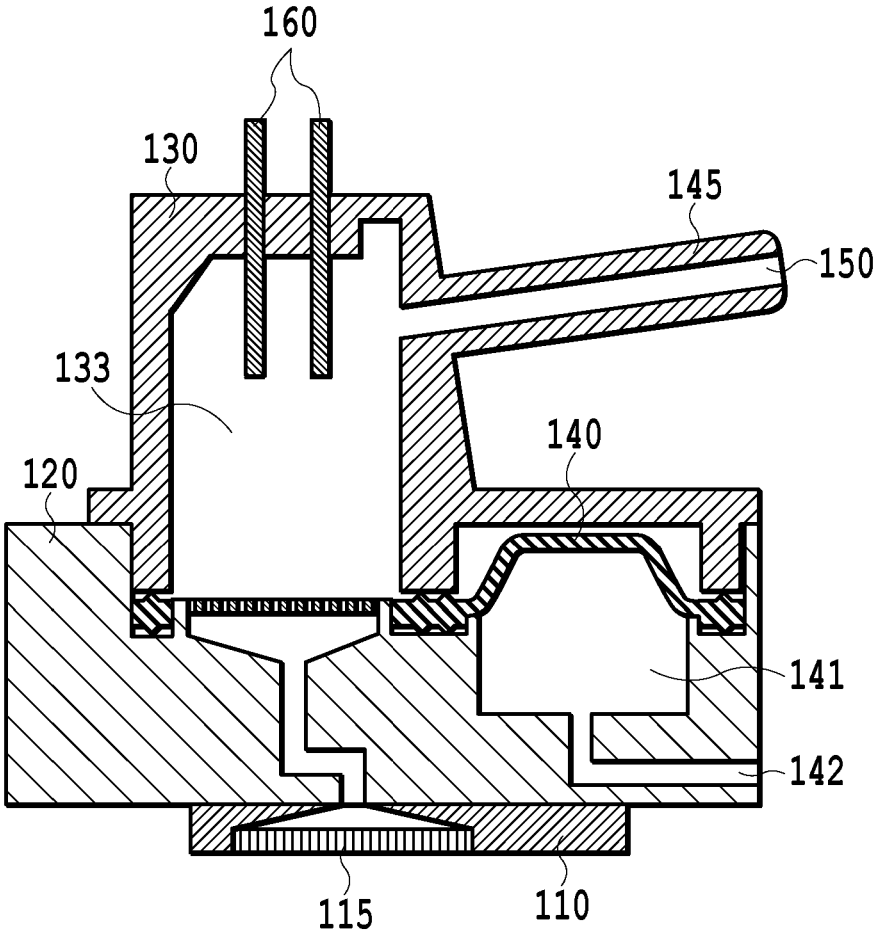
FIG. 4 is a schematic cross-sectional view of a sub tank as viewed from a side.

FIG. 4 is a schematic cross-sectional view of the sub tank 130 of FIG. 2 as viewed from a side. With reference to FIG. 4, the structure of the sub tank 130 will be described.

The sub tank 130 has a supply tube 145 protruding in a direction crossing a moving direction of a carriage and a flow inlet 150 at an end of the supply tube 145. The sub tank 130 is configured to engage with a supply port (not shown) of the main tank 170 via the supply tube 145. Furthermore, a plurality of sub tanks 130 are arranged in series on the ink tank unit 120 with respect to the moving direction of the carriage. More specifically, a joint chamber 133 is formed by providing a flexible member 140 on the ink tank unit 120 and providing the sub tank 130 on the flexible member 140. The main tank 170, as well as the sub tank 130, is coupled to the print head 110, and ink in the main tank is supplied to the print head 110 via the joint chamber 133.

Ink supplied to the print head 110 is ejected from an ejection port 115. A pair of electrode pins 160 is provided in the joint chamber 133. By bringing the electrode pins 160 into electrical conduction via the ink and comparing a voltage across the electrode pins 160 with a threshold, it is possible to determine whether ink remains in the main tank 170. In the determination on a remaining amount of ink by using the electrode pins 160 in the present invention, if a liquid level of ink is located higher than the electrode pins 160 in the joint chamber 133, it is determined that ink remains. If a liquid level of ink is located lower than the electrode pins 160, it is determined that ink does not remain.

In the present invention, bubbles are accumulated in the sub tank 130, such as bubbles entering the sub tank 130 from the main tank 170 when ink is supplied, bubbles produced by members due to a temperature change, and bubbles produced by ink being left for a long period of time. If the sub tank contains bubbles in an amount equal to or greater than a predetermined amount, that is, if the remaining amount of ink in the sub tank 130 is small, it is likely that supply of the ink from the main tank 170 has been stopped. If printing is performed under such conditions, shortage of the ink in the sub tank 130 in the middle of printing may stop the supply of the ink from the sub tank 130 to the print head 110, causing a malfunction in printing.

In addition, in the determination on whether ink remains by using the electrode pins 160, bubbles being accumulated in the sub tank 130 may cause a false detection: it may be determined that ink does not remain, even if ink still remains in the main tank 170, due to an influence of the bubbles. A bubble removal operation is then performed to remove bubbles in the sub tank 130 and prevent a malfunction in printing or a false detection.

(Regarding the Bubble Removal Operation)

Figure 5:
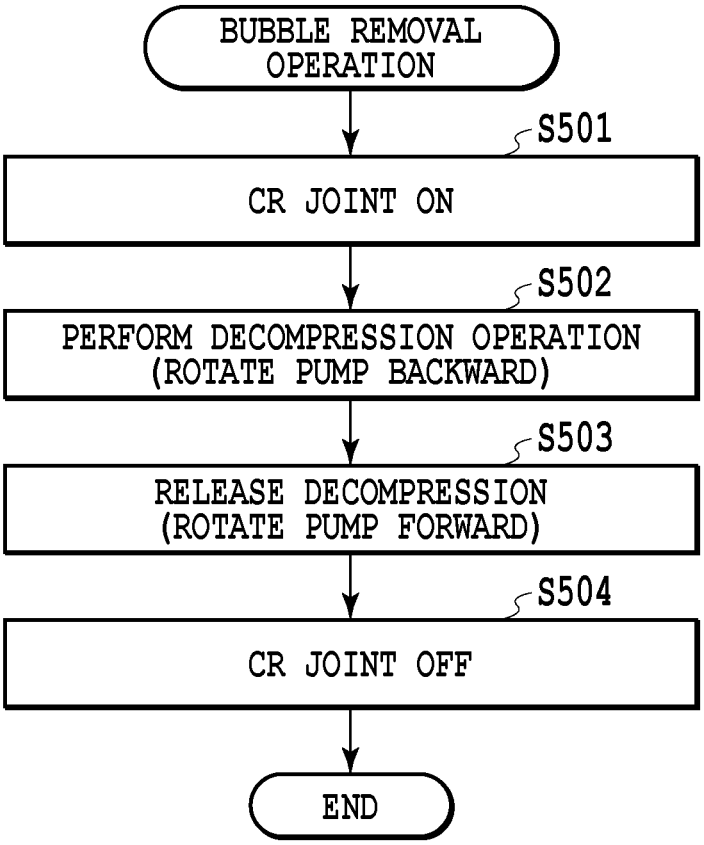
FIG. 5 is a flow chart of a bubble removal operation in the ink jet printing apparatus.
Figure 6A:
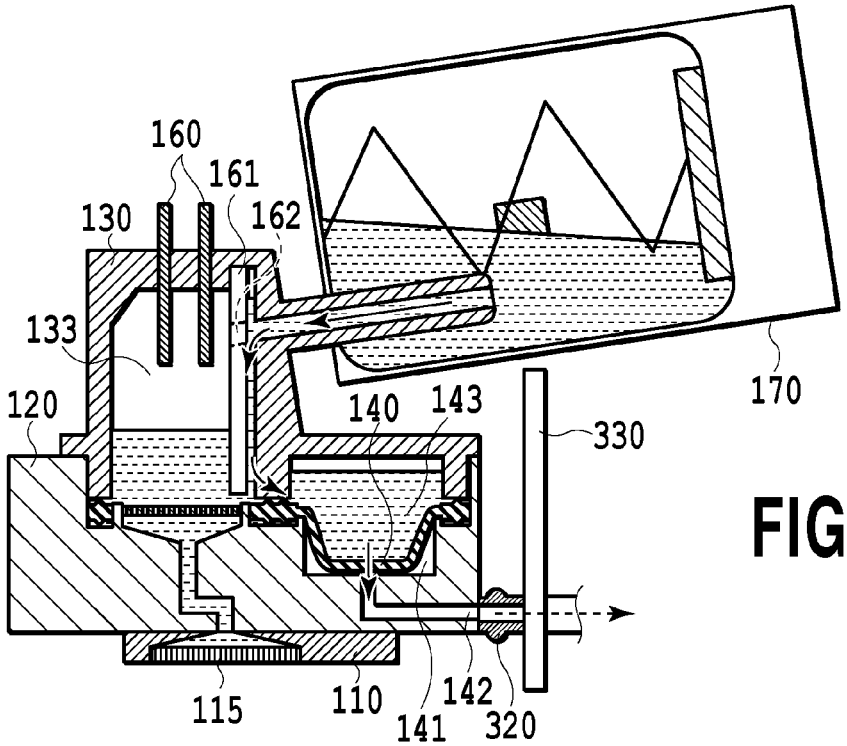
FIG. 6A is a view illustrating a flow of bubbles between a main tank and a sub tank.
Figure 6B:
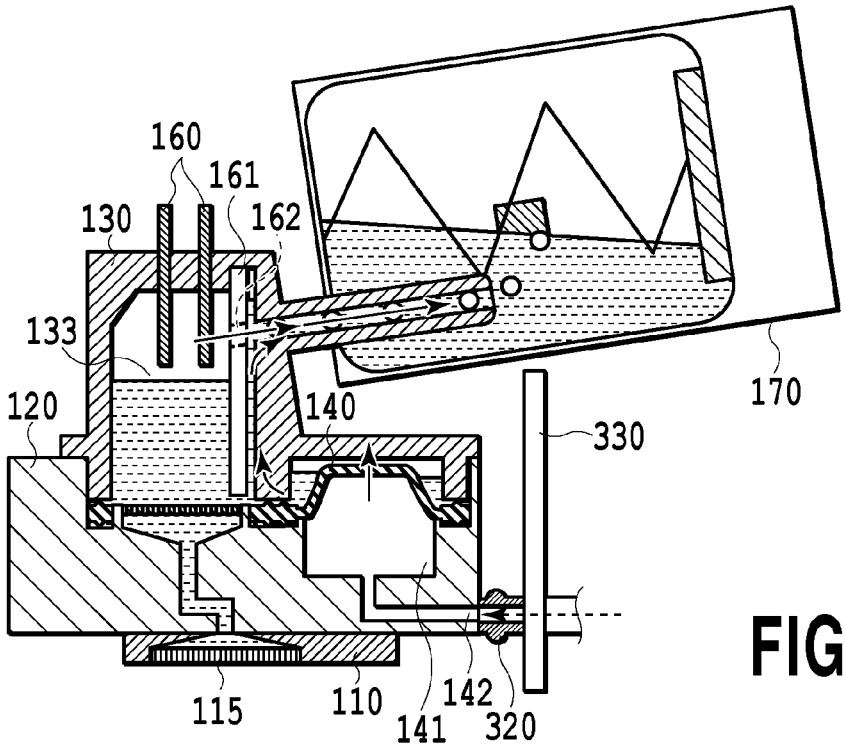
FIG. 6B is a view illustrating a flow of bubbles between a main tank and a sub tank.

FIG. 5 is a flow chart of a bubble removal operation in the ink jet printing apparatus of the present embodiment. FIGS. 6A and 6B are views illustrating flows of ink and bubbles between the main tank 170 and the sub tank 130 in the bubble removal operation. With reference to FIGS. 5, 6A, and 6B, a description will be given of the bubble removal operation according to the present embodiment.

Once the bubble removal operation is started, in step S501, the carriage unit 340 is moved to the right end of the ink jet printing apparatus 10. As a result, a suction pad 320 attached to the guide unit 330 comes into contact with a decompression port 142 of the ink tank unit 120. This allows a pump (not shown) to be in communication with the decompression port 142. A decompression chamber 141 is a space defined by the flexible member 140 and the ink tank unit 120. It is possible to adjust the pressure in the decompression chamber 141 through the decompression port 142. If a pump motor (not shown) for controlling an operation of the pump (not shown) connected to the suction pad 320 is rotated backward, the decompression chamber 141 is decompressed. If the pump motor is rotated forward, the decompression chamber 141 becomes in communication with atmosphere.

Next, in step S502, the pump motor is rotated backward to decompress the decompression chamber 141. As a result, the flexible member 140 deforms as shown in FIG. 6A, and ink in the main tank 170 is supplied to a buffer chamber 143 through the joint chamber 133. The joint chamber 133 in the sub tank 130 is provided with an ink retaining member 161, and the ink supplied from the main tank 170 flows between the ink retaining member 161 and a wall forming part of the joint chamber 133, and then is supplied to the buffer chamber 143.

Next, in step S503, the pump motor is rotated forward to allow the decompression chamber 141 to be in communication with atmosphere. As a result, the flexible member 140 is released from deformation as shown in FIG. 6B, and the ink in the buffer chamber 143 returns to the joint chamber 133 and the main tank 170. Also when the ink returns, the ink flows between the ink retaining member 161 and the wall forming part of the joint chamber 133, and returns to the main tank 170.

At the same time, some of the ink enters the joint chamber 133 as well. This causes air in the joint chamber 133 to have a higher pressure and accordingly to move from a bubble suction port 162 to the main tank 170. At this time, a venturi effect produced by the ink flowing between the ink retaining member 161 and the wall forming part of the joint chamber 133 causes the bubbles in the sub tank 130 to move from the bubble suction port 162 provided on the ink retaining member 161 to the main tank 170.

Next, in step S504, the carriage unit 340 is moved to the original position. The above-described bubble removal operation can cause the bubbles in the sub tank 130 to move to the main tank 170. The bubble removal operation can also produce an effect of stirring to uniformize components settled in the ink and reduce density unevenness in printed materials.

If the ink in the main tank 170 is used up, the main tank 170 is replaced with a new one. Depending on the time required for the replacement of the main tank 170, after the replacement of the main tank 170, the remaining amount of ink in the sub tank 30 may be small, and bubbles may occupy most part of the sub tank 130.

Furthermore, bubbles may enter the sub tank when the main tank 170 is replaced. If a printing operation is performed with the bubbles staying in the sub tank, ink may not be properly supplied, causing a malfunction in printing. Accordingly, it is necessary that the bubble removal operation of FIG. 5 be executed after the replacement of the main tank 170 to remove bubbles in the sub tank 130 and supply ink from the main tank 170.

Figure 7:
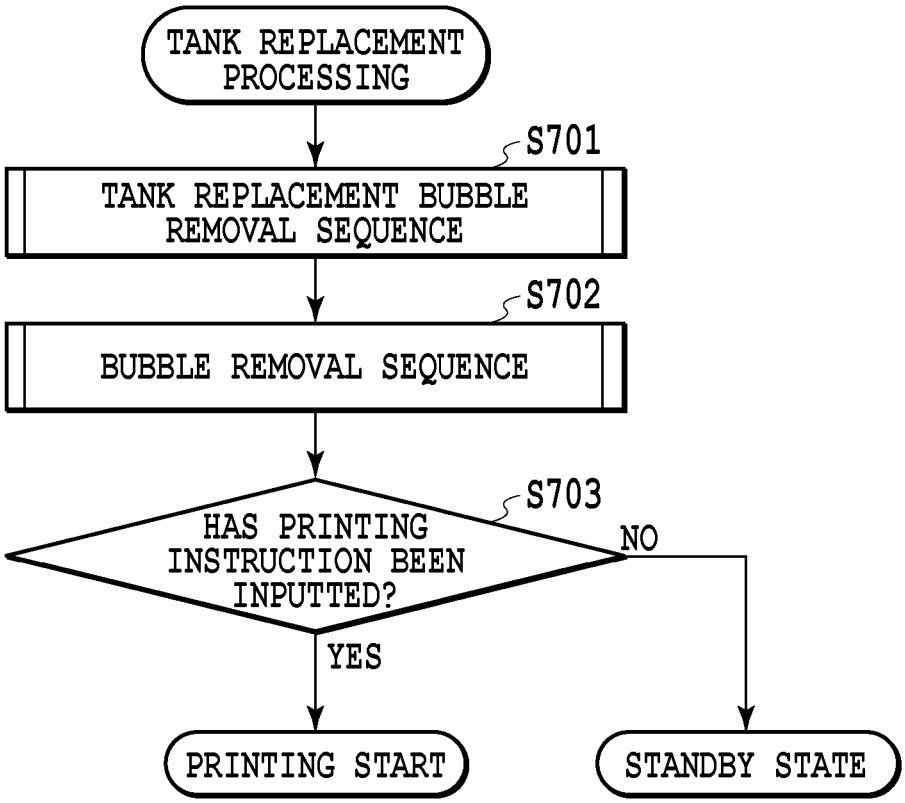
FIG. 7 is a flow chart of tank replacement processing when a main tank is replaced.

FIG. 7 is a flow chart of tank replacement processing performed when the main tank 170 is replaced. With reference to the flow chart, the tank replacement processing according to the present embodiment will now be described.

If a sensor of the ink jet printing apparatus 10 detects removal of the main tank 170, in step S701, a tank replacement bubble removal sequence is performed. Then, in step S702, a bubble removal sequence as will be described later is performed. Then, in step S703, it is determined whether a printing instruction is inputted. If inputted, a printing operation is started. If not, the apparatus enters a standby state. Performing a series of the above processing (tank replacement processing) in the replacement of the main tank 170 can maintain print quality and shorten the time before printing is started.

Figure 8:
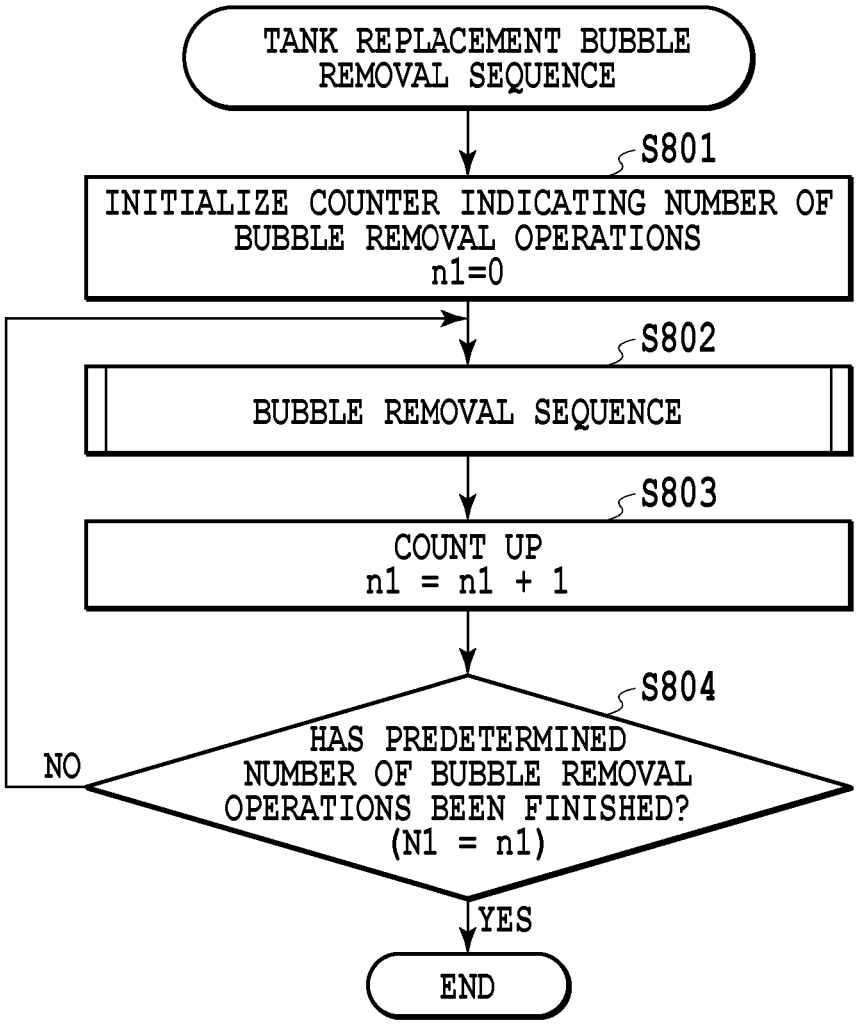
FIG. 8 is a flow chart of a tank replacement bubble removal sequence.
Figure 9:
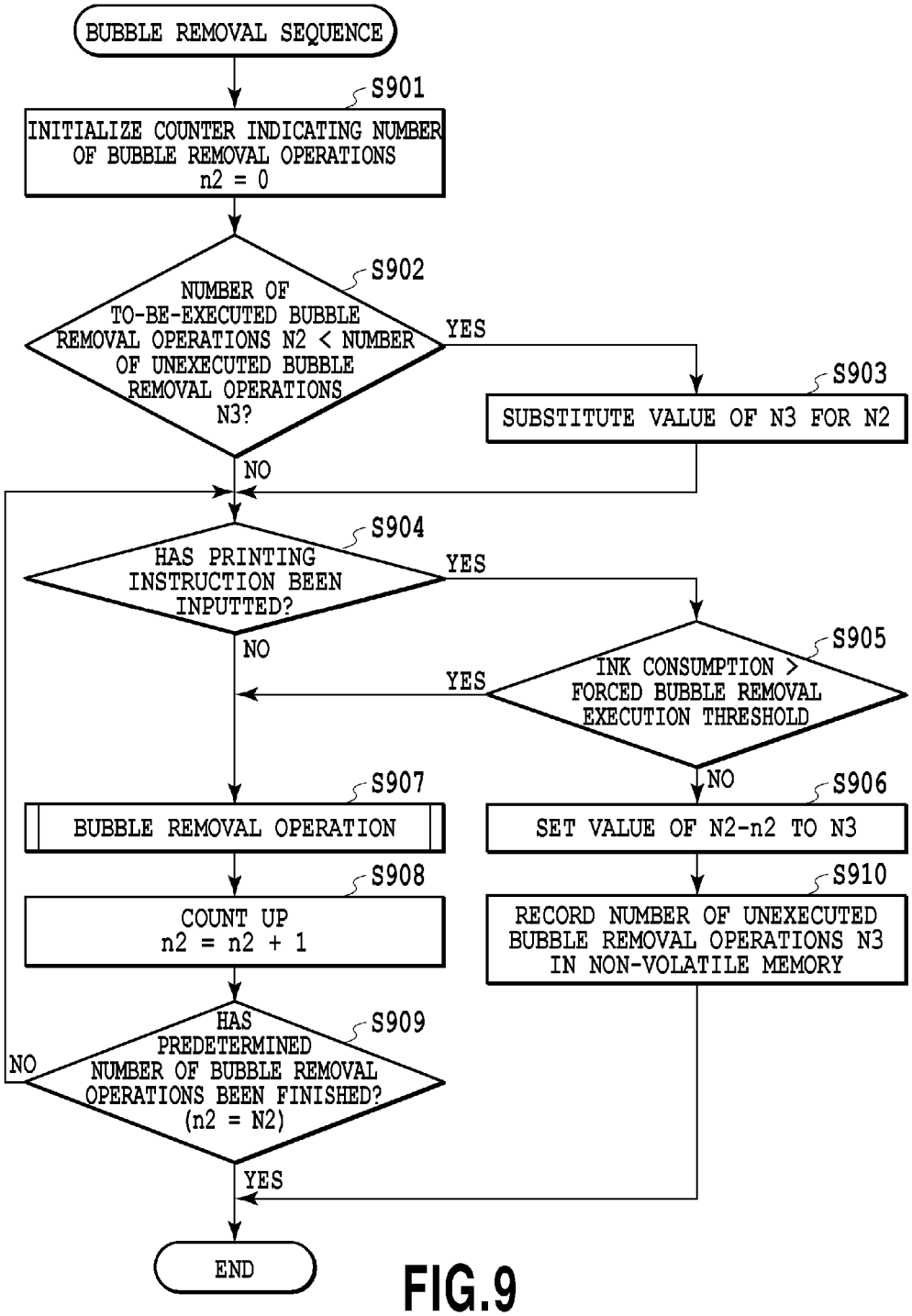
FIG. 9 is a flow chart showing a bubble removal sequence.

FIG. 8 is a flow chart of the tank replacement bubble removal sequence. FIG. 9 is a flow chart showing the bubble removal sequence. Performing recovery processing by the sequences of FIGS. 8 and 9 in the tank replacement processing of FIG. 7 allows subsequent printing processing. With reference to the flow charts of FIGS. 8 and 9, a description will be given of the tank replacement bubble removal sequence and the bubble removal sequence.

If the main tank 170 is replaced, bubbles may enter during the replacement. If a supply path is blocked by the bubbles, ink may not be supplied. To avoid stopping of the ink supply, the tank replacement bubble removal sequence is performed.

First, once the tank replacement bubble removal sequence is started, in step S801, a counter value n1 which stores a number of times the bubble removal operation has been executed is initialized (an initial value of n1 is 0). As used herein, the term "counter value n1" indicates a counter value which stores the number of bubble removal operations in the tank replacement bubble removal sequence. This does not include the number of bubble removal operations executed in another sequence. In step S802, the bubble removal operation illustrated in FIG. 5 is executed. Then in step S803, the counter value n1 which stores the number of times the bubble removal operation has been executed is incremented to count up the number of executions.

Next, in step S804, the counter value n1 indicating the number of times the bubble removal operation has been executed is compared with a printable number of times N1. As used herein, the term "printable number of times N1" means the number of bubble removal operations that allow a printing operation to be performed by removing the bubbles in the sub tank 130 and removing the bubbles which entered the supply path at the time of replacing the main tank 170, even under the circumstances where bubbles are difficult to be removed by the bubble removal operations. That is, the printable number of times N1 means a minimum number of bubble removal operations required for performing a printing operation. As used herein, the circumstances where bubbles are difficult to be removed by the bubble removal operations means circumstances where it is hard to remove bubbles in the sub tank 130 or supply ink, such as the case where ink having a high viscosity is used or the case where the ink jet printing apparatus 10 is placed in a low-temperature environment.

In step S804, if the counter value n1 is less than the printable number of times N1, the processing from step S802 to step S804 is repeated.

In step S804, if the counter value n1 is equal to the printable number of times N1, the tank replacement bubble removal sequence is finished. It should be noted that at this point, the sub tank 130 contains ink in an amount required for performing printing, and printing can be performed. However, bubbles remain in the sub tank 130, and it is preferable that bubble removal be further executed.

With reference to FIG. 9, a description will be given of the operation of the bubble removal sequence. In the bubble removal sequence, an input of a printing instruction from a user is determined each time the bubble removal operation of FIG. 5 is executed, and the bubble removal sequence is suspended.

Once the bubble removal sequence is started, in step S901, a counter value n2 which stores the number of times the bubble removal operation has been executed is initialized. As used herein, the term "counter value n2" indicates a counter value which stores the number of bubble removal operations executed in the bubble removal sequence. This does not include the number of bubble removal operations executed in another sequence. Then in step S902, a number of to-be-executed bubble removal operations N2 is compared with a number of unexecuted bubble removal operations N3 (an initial value of N3 is 0). If the number of unexecuted bubble removal operations N3 is greater than the number of to-be-executed bubble removal operations N2, in step S903, the number of unexecuted bubble removal operations N3 is substituted for the number of to-be-executed bubble removal operations N2.

As used herein, the term "number of to-be-executed bubble removal operations N2" means the number of bubble removal operations that can totally remove the bubbles in the sub tank 130 and required for ink to be sufficiently supplied to the sub tank 130 after execution of the printable number of times N1 of bubble removal operations, even under the circumstances where bubbles are difficult to be removed by the bubble removal operations. Furthermore, the term "number of unexecuted bubble removal operations N3" indicates a value generated if a bubble removal sequence is suspended by an input of a printing instruction, and also a value indicating the number of bubble removal operations that have not been executed due to suspension out of the number of bubble removal operations that should originally be executed (the number of to-be-executed bubble removal operations N2). This value is obtained by a difference between the number of to-be-executed bubble removal operations N2 and n2 indicating the number of bubble removal operations that have actually been executed.

In step S902, if the number of unexecuted bubble removal operations N3 is less than the number of to-be-executed bubble removal operations N2, the process proceeds to step S904. In step S904, it is determined whether a printing instruction has been inputted. In this manner, in the present embodiment, it is determined whether a printing instruction is inputted during a recovery operation, and if a printing instruction has not been inputted, the process proceeds to step S907 to execute the bubble removal operation of FIG. 5.

In step S908, the counter value n2 which stores the number of times the bubble removal operation has been executed is incremented to count up the number of executions. Then in step S909, the counter value n2 which stores the number of times the bubble removal operation has been executed is compared with the number of to-be-executed bubble removal operations N2. The processing from step S904 to step S908 is repeated until the counter value n2 which stores the number of times the bubble removal operation has been executed reaches the number of to-be-executed bubble removal operations. After executing the number of to-be-executed bubble removal operations, the bubble removal sequence is finished.

If it is determined whether a printing instruction has been inputted in step S904, it is checked whether an ink consumption in the main tank 170 is greater than a forced bubble removal execution threshold in step S905. As used herein, the term "forced bubble removal execution threshold" indicates a value of an ink consumption after the main tank 170 is replaced, and a value of an ink consumption at which a small amount of ink remaining in the main tank 170 causes bubbles to easily enter the sub tank 130. In the check in step S905, it is determined whether the bubble removal sequence can be suspended.

This determination is made on a remaining amount of ink in the main tank 170, so that it is determined whether there is a possibility that printing cannot be performed, caused by bubbles supplied from the main tank 170 due to a small amount of ink remaining in the main tank 170.

If there is a sufficient amount of ink in the main tank 170, bubbles will not be supplied from the main tank 170. In this case, printing can be performed even without executing the planned number of bubble removal operations. If there is not a sufficient amount of ink in the main tank 170, however, bubbles may be supplied. In this case, the bubble removal operations need to be executed.

In step S905, if there is a sufficient amount of ink in the main tank 170 and the bubble removal sequence is suspended, the process proceeds to step S906. Then in step S906, a difference between the number of to-be-executed bubble removal operations N2 and the counter value n2 is set to the number of unexecuted bubble removal operations N3, and in step S910, a value of the number of unexecuted bubble removal operations N3 is stored in the non-volatile memory 25. The non-volatile memory 25 can keep storing the number of unexecuted bubble removal operations N3 even if the ink jet printing apparatus 10 is turned OFF while the bubble removal sequence is not completed. After that, even if the ink jet printing apparatus is turned ON, control may be performed while the bubble removal sequence is not completed. If the value of the number of unexecuted bubble removal operations N3 is stored in the non-volatile memory 25, the bubble removal sequence is finished.

A description will now be given of the printable number of times N1 of the bubble removal operation, the number of to-be-executed bubble removal operations N2, and the number of unexecuted bubble removal operations N3 with specific examples. By way of example, the printable number of times N1 of the bubble removal operation in the tank replacement bubble removal sequence of FIG. 8 is set to 3, and the number of to-be-executed bubble removal operations N2 in the bubble removal sequence of FIG. 9 is set to 5. In this case, the bubble removal operation is executed eight times in total, so that bubbles in the sub tank 130 are totally removed and there is a sufficient amount of ink in the sub tank 130.

After the main tank 170 is replaced and the bubble removal operation is executed three times in the tank replacement bubble removal sequence, the bubble removal sequence of FIG. 9 is performed. In the bubble removal sequence, if a printing instruction is inputted after executing the bubble removal operation once, the bubble removal sequence can be suspended because the main tank 170 still contains a sufficient amount of ink and will not supply bubbles. Then, the number of unexecuted bubble removal operations N3 is determined to be 4, that is, (N2-1), and stored in the non-volatile memory 25.

As described above, if the bubble removal sequence is suspended by an input of a printing instruction (if the number of unexecuted bubble removal operations N3 has a value), bubbles which had presumably entered at the time of replacing the main tank 170 have been removed by executing the printable number of times N1 of the bubble removal operations. Accordingly, the bubbles do not block the ink supply path and printing can be performed. In such a state, however, the bubbles in the sub tank 130 have not been fully removed. Therefore, it is necessary that the bubble removal sequence be performed at a predetermined timing, and the bubble removal operation be executed for the number of unexecuted bubble removal operations N3 stored in the non-volatile memory 25. A description will be given of a predetermined timing at which the bubble removal operation is executed for the number of unexecuted bubble removal operations N3.

A timing at which the bubble removal operation is executed for the number of unexecuted bubble removal operations N3 may be during a standby time, between printing processing and subsequent printing processing, or at the end of using the ink jet printing apparatus. It should be noted that a timing at which the bubble removal operation is executed is not limited to this. The bubble removal operation may be executed during other processing.

Figure 10:
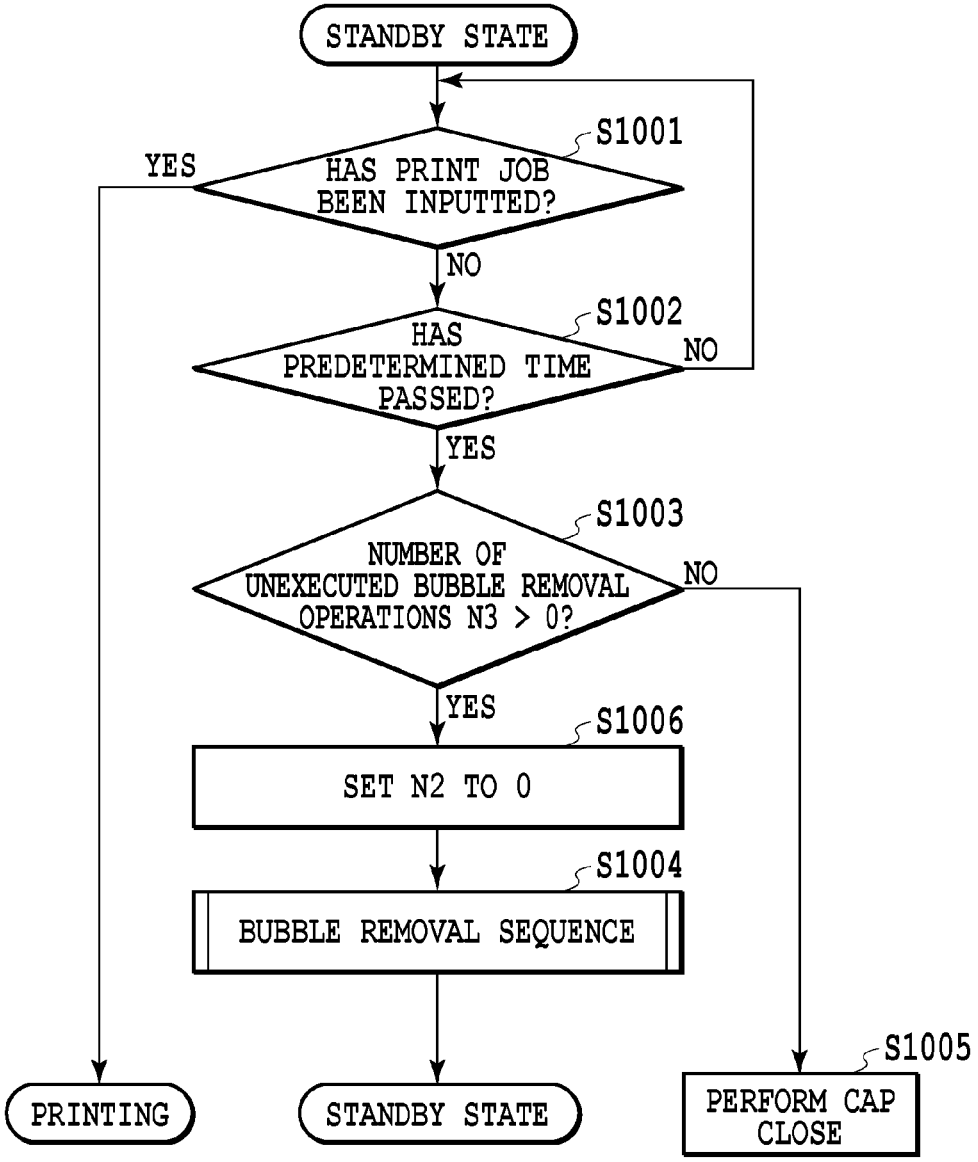
FIG. 10 is a flow chart showing a process of performing the bubble removal sequence.

FIG. 10 is a flow chart showing a process of executing the bubble removal sequence from a standby state of the ink jet printing apparatus. In the bubble removal sequence in this process, the bubble removal operation is executed for the number of unexecuted bubble removal operations N3. With reference to the flow chart, a description will be given of the process of executing the bubble removal sequence from a standby state of the ink jet printing apparatus 10.

If a printing instruction is inputted in the standby state of the ink jet printing apparatus 10, in step S1001, it is determined that a printing instruction has been inputted, and printing is started like the conventional ink jet printing apparatus 10. In this case, a bubble removal sequence is not performed because the ink jet printing apparatus 10 is no longer in the standby state.

In step S1001, if it is determined that a printing instruction has not been inputted by a user, the process proceeds to step S1002, and it is determined whether a predetermined time has passed in the standby state. As used herein, the predetermined time means a time required for protecting the print head 110 by a cap member to avoid a malfunction in printing caused by adhesion of dried ink attached to the surface of the print head 110. An operation of protecting the print head 110 is hereinafter referred to as a cap close. If the predetermined time has not passed in the standby state, the process returns to step S1001, and the processing is repeated.

If it is determined that the predetermined time has passed in step S1002, in step S1003, it is determined whether a value of the number of unexecuted bubble removal operations N3 stored in the non-volatile memory 25 is greater than 0. In step S1003, if a value of the number of unexecuted bubble removal operations N3 is 0, in step S1005, a cap close is performed. In step S1003, if the number of unexecuted bubble removal operations N3 is greater than 0, the number of to-be-executed bubble removal operations N2 is set to 0 in step S1006, and in step S1004, the bubble removal sequence of FIG. 9 is performed. Also in the bubble removal sequence in step S1004, it is checked whether a printing instruction has been inputted by a user each time the bubble removal operation is executed once. If a printing instruction has been inputted, the bubble removal sequence is suspended before printing is performed.

As described above, in the standby state of the ink jet printing apparatus, the bubble removal operation is executed for the number of unexecuted bubble removal operations.

Figure 11:
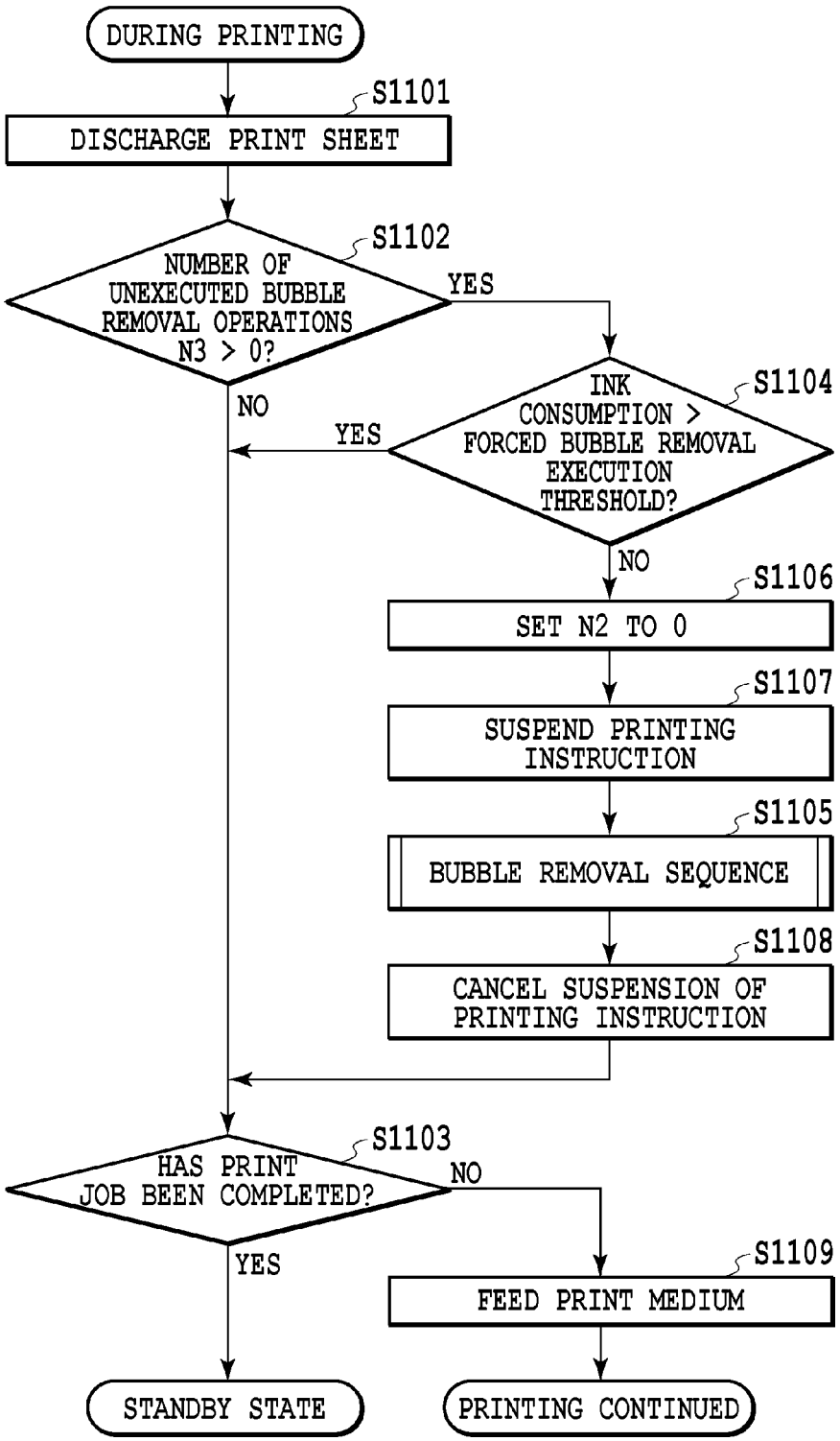
FIG. 11 is a flow chart showing a process of performing the bubble removal sequence.

FIG. 11 is a flow chart showing a process of performing the bubble removal sequence while the ink jet printing apparatus is performing printing processing. In the bubble removal sequence in this printing processing, the bubble removal operation is executed for the number of unexecuted bubble removal operations N3. With reference to the flow chart, a description will be given of the process of performing the bubble removal sequence while the printing processing is performed.

If a print medium is discharged during the printing processing in step S1101, in step S1102, it is determined whether the number of unexecuted bubble removal operations N3 stored in the non-volatile memory 25 is greater than 0. In this check, it is determined whether the bubble removal sequence of FIG. 9 after the replacement of the main tank 170 is suspended and printing is performed. If it is determined that the bubble removal sequence is not suspended in step S1102 (if N3=0), the sub tank 130 is in a state where bubbles have totally been removed.

In this state, the bubbles in the sub tank 130 are less likely to be supplied to the print head 110, and further, ink can be properly supplied to the print head 110. Therefore, continuous printing will not adversely affect print quality. Accordingly, if it is determined that the number of unexecuted bubble removal operations N3 is greater than 0 in step S1102, the process proceeds to step S1103 to determine whether printing has been completed. If it is determined that printing has not been completed, a print medium is fed in step S1107 to perform printing. If it is determined that printing has been completed in step S1103, the ink jet printing apparatus changes to the standby state.

If the number of unexecuted bubble removal operations N3 is greater than 0 in step S1102, printing can be performed, but the sub tank 130 is in a state where bubbles still remain. Then in step S1104, it is checked whether there is a sufficient amount of ink in the main tank 170. If there is a sufficient amount of ink, the bubbles are less likely to be supplied to the sub tank 130, and accordingly, the process proceeds to step S1103 without performing the bubble removal sequence. In step S1104, if there is not a sufficient amount of ink in the main tank 170, the bubbles are likely to be supplied to the sub tank 130. Then in step S1106, the number of to-be-executed bubble removal operations N2 is set to 0, and in step S1107, a printing instruction is suspended, and the process proceeds to step S1105 to perform the bubble removal sequence. After the bubble removal sequence, in step S1108, the suspension of the printing instruction is cancelled, and the process proceeds to step S1103.

In this manner, the bubble removal operation is executed for the number of unexecuted bubble removal operations between a printing operation and a subsequent printing operation in the printing processing of the ink jet printing apparatus.

Figure 12:
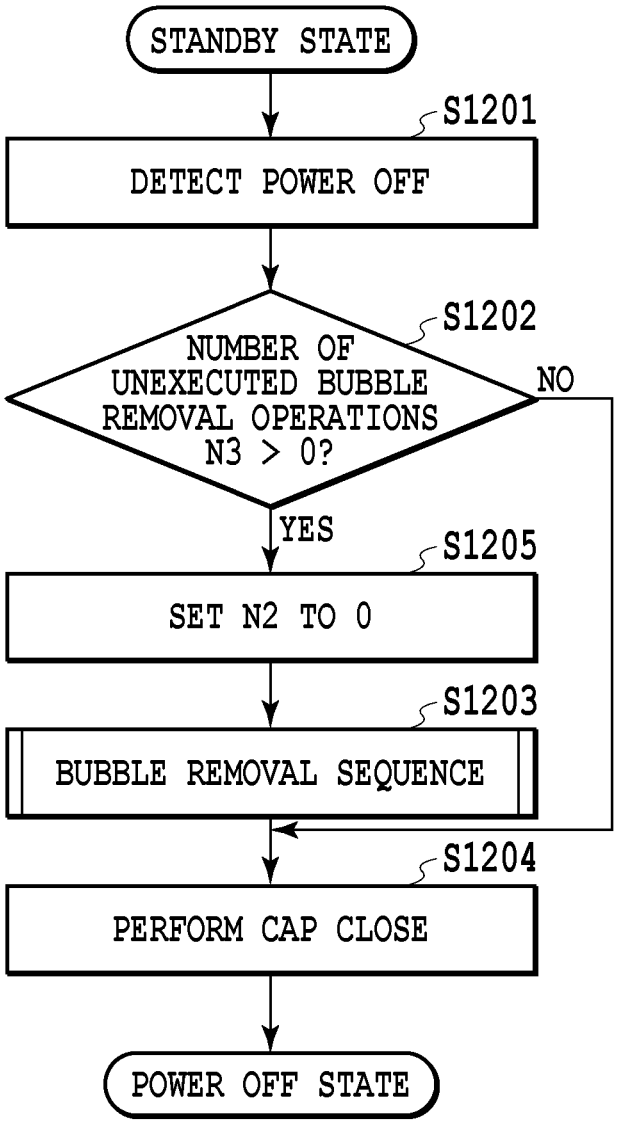
FIG. 12 is a flow chart showing processing in powering OFF.

FIG. 12 is a flow chart showing processing in turning OFF the ink jet printing apparatus. In the bubble removal sequence in this printing processing, the bubble removal operation is executed for the number of unexecuted bubble removal operations N3. With reference to the flow chart, a description will be given of the process of performing the bubble removal sequence while performing the processing in powering OFF.

If an instruction is received to turn OFF the ink jet printing apparatus in step S1201, in step S102, it is checked whether the number of unexecuted bubble removal operations N3 stored in the non-volatile memory 25 is greater than 0. In this check, it is determined whether the bubble removal sequence is suspended. If it is determined that the number of unexecuted bubble removal operations N3 is greater than 0 and the bubble removal sequence is suspended, in step S1205, the number of to-be-executed bubble removal operations N2 is set to 0, and the bubble removal sequence is performed in step S1203. Through the bubble removal sequence, it is possible to execute the number of bubble removal operations that were pending during suspension. Then in step S1204, the cap is closed to turn OFF the ink jet printing apparatus.

In step S1202, if it is determined that the number of unexecuted bubble removal operations N3 is not greater than 0 and the bubble removal sequence is not suspended, the process proceeds to step S1204, and the cap is closed to turn OFF the ink jet printing apparatus. In this manner, in the processing of turning OFF the ink jet printing apparatus, the bubble removal operation is executed for the number of unexecuted bubble removal operations.

It should be noted that in the present embodiment, a description has been given of the processing of the bubble removal operation to maintain print quality. This control configuration can be applied to other processing, such as ink tank stirring processing performed for a predetermined number of times (amount) to maintain print quality and suction recovery processing of a print head. More specifically, in the ink tank stirring processing or the like, of the number of times of the stirring processing that can sufficiently stir the inside of the ink tank, stirring is performed for a number of times that allows printing, and with respect to the remaining number of times, it is determined whether to perform stirring or to suspend stirring depending on the amount of ink in the ink tank (a state of a factor affecting a printing performance). In this case, stirring can be suspended if the amount of ink in the ink tank is small, but stirring cannot be suspended if the amount of ink is large.

This is because with a small amount of ink in the ink tank, the ink can be sufficiently stirred even with a small number of times of stirring, whereas with a large amount of ink, suspension may affect printing due to insufficient stirring.

As described above, in performing recovery processing multiple times to recover ejection, if a printing instruction is inputted, depending on the state of a factor affecting a printing performance, the recovery processing is suspended with an amount of ink that is smaller than the amount in the recovery processing required for recovery. This can achieve an ink jet printing apparatus that does not give poor usability to users and a method for controlling the same.

Second Embodiment

With reference to the drawings, a second embodiment of the present invention will now be described. It should be noted that the basic configuration of the present embodiment is the same as that of the first embodiment. Only a featured configuration will now be described.

Figure 13:
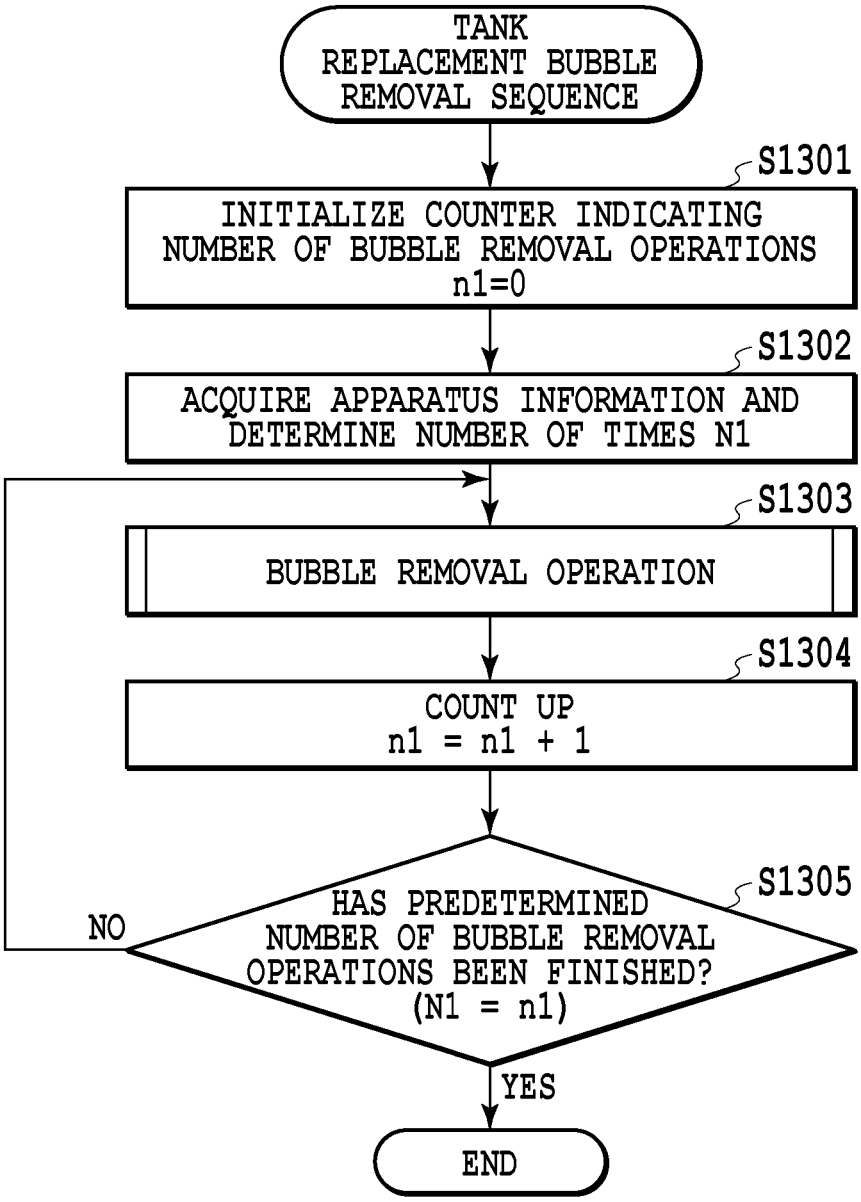
FIG. 13 is a flow chart showing a tank replacement bubble removal sequence.
Figure 14:
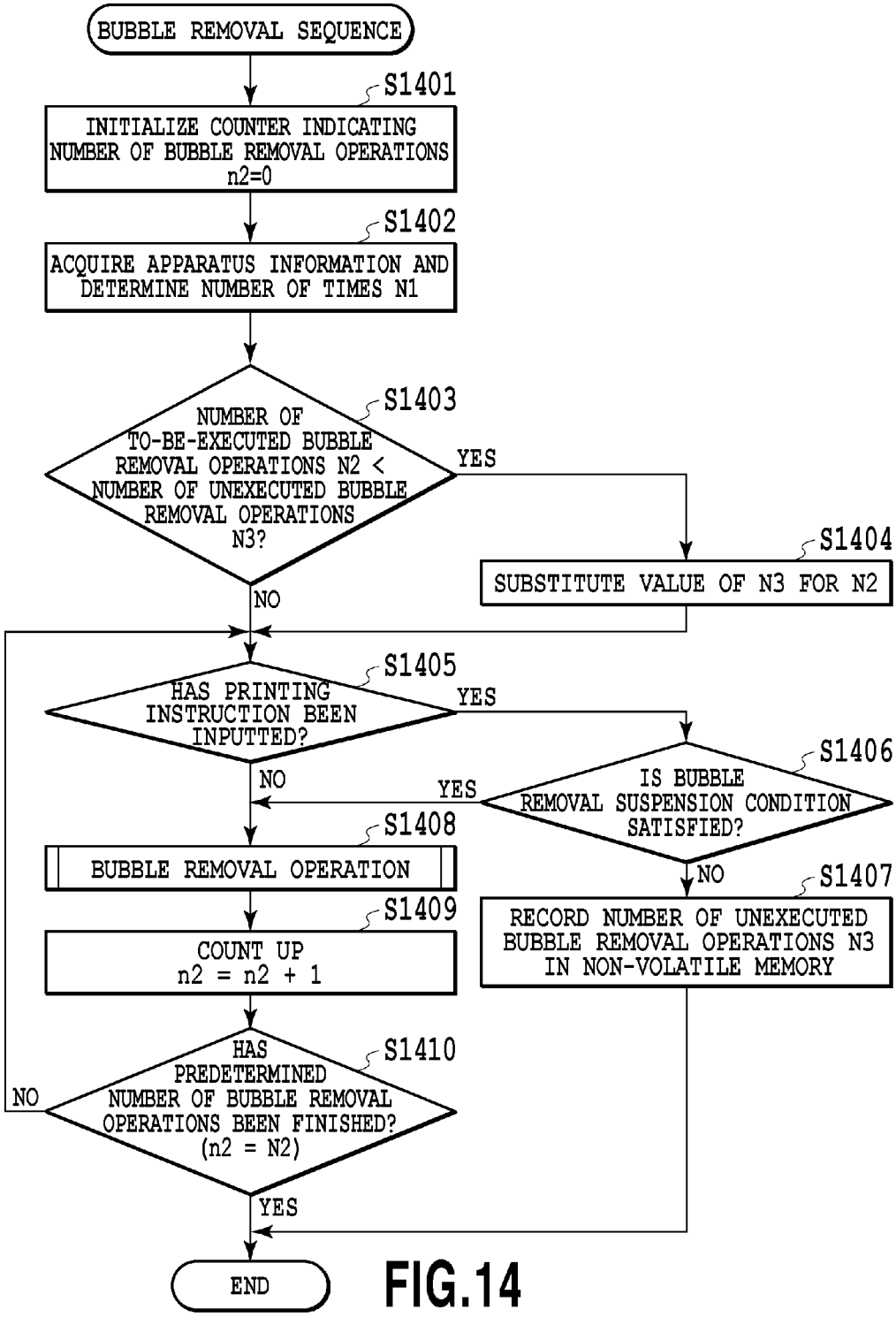
FIG. 14 is a flow chart showing a bubble removal sequence of the present embodiment.

FIG. 13 is a flow chart showing a tank replacement bubble removal sequence according to the present embodiment. FIG. 14 is a flow chart showing a bubble removal sequence of the present embodiment. With reference to the flow charts, a description will be given of the tank replacement bubble removal sequence and the bubble removal sequence according to the present embodiment.

First, in the tank replacement bubble removal sequence of FIG. 13, a difference from the first embodiment is that a value of a printable number of times N1 of bubble removal operations varies depending on the state of an ink jet printing apparatus 10 in step S1302. In the first embodiment, the printable number of times N1 of bubble removal operations indicates the number of bubble removal operations that allow a printing operation to be performed by removing the bubbles in the sub tank 130 and removing the bubbles which entered the supply path at the time of replacing the main tank 170, even under the circumstances where bubbles are difficult to be removed by the bubble removal operations.

For instance, under the circumstances where the effect of the bubble removal operation is low, such as the case where ink having a high viscosity is used and the ink jet printing apparatus 10 is placed in a low-temperature environment, the number of bubble removal operations needed to allow printing is set to 3. In this case, in the first embodiment, even if an ink having a low viscosity is used, the ink jet printing apparatus 10 is placed in a high-temperature environment, and the effect of the bubble removal operation is relatively high, the printable number of times N1 is set to 3.

Under the circumstances where the effect of the bubble removal operation is high, however, if printing becomes possible after performing the bubble removal operation only twice, fixing the number of bubble removal operations to 3 may result in the fact that an extra bubble removal operation is performed. Then in step S1302, information such as a type of ink and an environmental temperature in the ink jet printing apparatus 10 is acquired, and with reference to a table provided in the ink jet printing apparatus in advance, the printable number of times N1 of bubble removal operations is changed to an appropriate value. This can optimize a time from input of a printing instruction to start of printing.

In the bubble removal sequence of FIG. 14, a difference from the first embodiment is that a value of a number of to-be-executed bubble removal operations N2 varies depending on the state of the ink jet printing apparatus 10 in step S1402. In the first embodiment, the number of to-be-executed bubble removal operations N2 indicates the number of bubble removal operations, as a fixed value, that can totally remove the bubbles in the sub tank 130 and required for ink to be sufficiently supplied to the sub tank 130, even under the circumstances where the effect of the bubble removal operation is low. For example, under the circumstances where the effect of the bubble removal operation is low, such as the case where ink having a high viscosity is used and the ink jet printing apparatus 10 is placed in a low-temperature environment, the number of bubble removal operations needed to allow printing is set to 5.

In this case, in the first embodiment, even if an ink having a low viscosity is used, the ink jet printing apparatus 10 is placed in a high-temperature environment, and the effect of the bubble removal operation is relatively high, the number of to-be-executed bubble removal operations N2 is set to 5. Under the circumstances where the effect of the bubble removal operation is high, however, if printing becomes possible after performing the bubble removal operation only three times, fixing the number of bubble removal operations to 5 may result in the fact that two extra bubble removal operations are performed. Accordingly, in the present embodiment, in step S1402, information such as a type of ink and an environmental temperature in the ink jet printing apparatus 10 is acquired, and with reference to a table provided in the ink jet printing apparatus in advance, the number of to-be-executed bubble removal operations N2 is changed to an appropriate value. This can optimize the number of bubble removal operations, and even if the bubble removal sequence is not suspended as shown in FIG. 11, unnecessary bubble removal operations can be reduced, leading to improvement of usability.

According to the above configuration, if a printing instruction is inputted by a user after the replacement of the main tank 170, a recovery operation is suspended after performing a minimum number of times of recovery processing, and then printing is performed. Such control can maintain print quality and shorten a time before printing is started, and accordingly it is possible to improve usability to users. In addition, the number of times of recovery processing that has not been executed due to suspension is performed at a timing at which the user is assumed not to be using the ink jet printing apparatus. In this respect, it is also possible to improve usability to users.

It should be noted that the present invention should not be limited to the above described embodiments. The present invention may be appropriately modified within the scope of the claims and the scope equivalent to the scope of the claims as long as the modification is based on the technical concept of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-170344 filed Aug. 25, 2014, which is hereby incorporated by reference wherein in its entirety.

What is claimed is:

1. An ink jet printing apparatus comprising:

a print head for performing a printing operation for printing an image on a print medium by ejecting ink;

a sub tank for containing ink to be supplied to the print head;

a main tank for containing ink to be supplied to the sub tank;

a decompression unit for performing decompression in the sub tank;

a control unit configured to perform a bubble removal process in which a bubble removal operation is performed a predetermined number of times to move bubbles in the sub tank to the main tank, the bubble removal operation comprising performing and releasing the decompression in the sub tank; and a determination unit configured to determine whether to perform the printing operation before the bubble removal operation is performed the predetermined number of times, or after the bubble removal operation is performed the predetermined number of times, in a case where the ink jet printing apparatus receives a printing command during execution of the bubble removal process.

2. The ink jet printing apparatus according to claim 1, wherein the determination unit determines, based on the amount of ink in the main tank, whether to perform the printing operation before the bubble removal operation is performed the predetermined number of times, or after the bubble removal operation is performed the predetermined number of times.

3. The ink jet printing apparatus according to claim 1, wherein the determination unit determines to perform the printing operation prior to the performance of the bubble removal operation the predetermined number of times, in a case where the amount of ink in the main tank is greater than a predetermined amount of ink.

4. The ink jet printing apparatus according to claim 1, wherein in a case where the determination unit determines to perform the printing operation before the predetermined number of the bubble removal operations are completed, the control unit performs, at a predetermined timing after performing the printing operation, a remaining number of bubble removal operations to complete the predetermined number of bubble removal operations.

5. The ink jet printing apparatus according to claim 4, wherein the predetermined timing is a timing at least one of (i) during processing of turning OFF the ink jet printing apparatus, (ii) during a standby state of the ink jet printing apparatus for printing, and (iii) between one printing operation and a subsequent printing operation of the ink jet printing apparatus.

6. A method for controlling an ink jet printing apparatus comprising a print head for performing a printing operation for printing an image on a printing medium by ejecting ink, a sub tank for containing ink to be supplied to the print head, a main tank for containing ink to be supplied to the sub tank, and a decompression unit for performing decompression in the sub tank, the method comprising:

a bubble removal step in which a bubble removal operation is performed a predetermined number of times to move bubbles in the sub tank to the main tank, the bubble removal operation comprising performing and releasing the decompression in the sub tank; and a determination step of determining whether to perform the printing operation before the bubble removal operation is performed the predetermined number of times, or after the bubble removal operation is performed the predetermined number of times, in a case where the ink jet printing apparatus receives a printing command during execution of the bubble removal step.

* * * * *